US007249801B2

(12) United States Patent
Tonin

(10) Patent No.: US 7,249,801 B2
(45) Date of Patent: Jul. 31, 2007

(54) CUSHIONING DEVICE TO CUSHION THE BACKREST OF A CHAIR, AN ARMCHAIR, AN OFFICE CHAIR OR SIMILAR

(75) Inventor: Luigi Tonin, Asolo (IT)

(73) Assignee: Erreti SNC Di Rinaldo Tonin & C., Asolo (TV) (IT)

( * ) Notice: Subject to any disclaimer, the term of this patent is extended or adjusted under 35 U.S.C. 154(b) by 57 days.

(21) Appl. No.: 10/546,175

(22) PCT Filed: Feb. 24, 2004

(86) PCT No.: PCT/IB2004/000426

§ 371 (c)(1),
(2), (4) Date: Aug. 18, 2005

(87) PCT Pub. No.: WO2004/075691

PCT Pub. Date: Sep. 10, 2004

(65) Prior Publication Data

US 2006/0061171 A1 Mar. 23, 2006

(30) Foreign Application Priority Data

Feb. 25, 2003 (IT) ..... UD2003A0042

(51) Int. Cl.
*A47C 1/024* (2006.01)
*A47C 3/026* (2006.01)

(52) U.S. Cl. ..... 297/300.5; 297/289; 297/291; 297/296; 297/300.6; 297/300.7; 297/300.8; 297/301.1; 297/301.4; 297/301.5; 297/301.6; 297/301.7

(58) Field of Classification Search ..... 297/300.5, 297/300.1, 300.2, 300.6, 300.7, 300.8, 301.4, 297/301.1, 301.5, 301.6, 301.7, 289, 291, 297/296, 299
See application file for complete search history.

(56) References Cited

U.S. PATENT DOCUMENTS

| | | | | | |
|---|---|---|---|---|---|
| 357,183 | A | | 2/1887 | Lee | |
| 2,398,072 | A | * | 4/1946 | Boerner | 297/301.4 |
| 2,456,797 | A | * | 12/1948 | Sheldrick | 297/300.5 |
| 2,662,586 | A | * | 12/1953 | Cramer | 297/291 |
| 2,672,922 | A | * | 3/1954 | Freund | 297/301.4 |
| 3,042,448 | A | * | 7/1962 | Hamilton | 297/300.5 |

(Continued)

FOREIGN PATENT DOCUMENTS

| | | |
|---|---|---|
| DE | 854250 | 11/1952 |

(Continued)

*Primary Examiner*—Rodney B. White
(74) *Attorney, Agent, or Firm*—Stevens, Davis, Miller & Mosher, LLP

(57) ABSTRACT

Cushioning device to cushion a backrest with respect to the seat of a chair or suchlike. The device comprises a first supporting element connected to the backrest, a second supporting element connected to the seat and pinned to the first supporting element, and a spring connected both to the first supporting element and to the second supporting element, to allow a reciprocal elastic oscillation, of a determined amplitude, between the backrest, which can oscillate, and the seat, which remain still. In a wall of the first supporting element a lodging seat is provided to lodge, at least partially, the spring in such a manner that the longitudinal axis of the spring is substantially aligned with respect to the first supporting element.

11 Claims, 3 Drawing Sheets

U.S. PATENT DOCUMENTS

| | | | | | |
|---|---|---|---|---|---|
| 3,133,763 | A | * | 5/1964 | Stoll et al. | 297/300.7 |
| 3,339,973 | A | * | 9/1967 | Doerner | 297/300.7 X |
| 3,441,311 | A | | 4/1969 | Doerner | 297/301.4 |
| 3,602,537 | A | * | 8/1971 | Kerstholt | 297/300.5 |
| 3,603,640 | A | | 9/1971 | Doerner | 297/300.4 |
| 3,989,297 | A | * | 11/1976 | Kerstholt | 297/300.5 X |
| 4,756,575 | A | | 7/1988 | Dicks | 297/300.5 |
| 5,108,149 | A | * | 4/1992 | Ambasz | 297/300.5 X |
| 5,452,937 | A | | 9/1995 | Piretti | |
| 5,868,468 | A | * | 2/1999 | Wang | 297/300.5 X |
| 6,003,942 | A | * | 12/1999 | Haas | 297/300.5 |
| 6,220,664 | B1 | | 4/2001 | Lee | |

FOREIGN PATENT DOCUMENTS

| | | |
|---|---|---|
| DE | 3635243 | 4/1988 |
| EP | 0904713 | 3/1999 |
| EP | 1161902 | 12/2001 |
| GB | 609242 | 9/1948 |

* cited by examiner

CUSHIONING DEVICE TO CUSHION THE BACKREST OF A CHAIR, AN ARMCHAIR, AN OFFICE CHAIR OR SIMILAR

This application is a §371 National Stage Application of International Application No. PCT/IB2004/000426, filed on Feb. 24, 2004, claiming the priority of Italian Patent Application No. UD2003A000042 filed on Feb. 25, 2003.

FIELD OF THE INVENTION

The present invention concerns a device to cushion the backrest of a chair, an armchair, an office chair or suchlike. In the following text, the term "chair" shall be taken to mean any element of furniture provided with a seat and a backrest. The device according to the present invention comprises at least an axial load elastic element, which can be for example a helical spring, a gas piston or otherwise, and which is arranged between the backrest and the seat of the chair, preferably in proximity with their pivoting axis, so as to allow an elastic movement, of a determined amplitude, of the backrest with respect to the seat.

BACKGROUND OF THE INVENTION

It is known that in chairs, especially those for offices, or more generally for places of work, in order to cushion the backrest with respect to the seat, cushioning devices are used provided with one or more springs. In the simplest devices a single torsion spring is normally used, mounted coaxial to a pin which rotatably connects a metal upright of the backrest with a metal base of the seat. To be more exact, such torsion springs have one end attached to the upright of the backrest and another end attached to the base of the seat.

Such known cushioning devices have the disadvantage, however, that they do not support a large number of stresses, or actuation cycles, or bending of the backrest with respect to the seat. Torsion springs, in fact, do not exceed the stresses required by safety regulations, such as the European norm EN 1335-3, which lays down that devices mounted on chairs must resist up to at least 120,000 cycles before breaking.

It is clear therefore that these known devices do not meet the required characteristics, and thus make the chairs on which they are applied not very reliable, unsafe and poor quality.

From U.S. Pat. No. 4,756,575 it is known a frame assembly for a chair which includes a base member, a seat support member and a backrest member. The front end of the seat support member is pivotally mounted on the front end of the base member and a seat suspension spring is provided for the purposes of urging the seat support member to its elevated position, while allowing the inclination both of the seat and of the backrest. The seat suspension spring is a compression spring mounted rearward of and extending longitudinally of the backrest member. In particular the compression spring is compressed between an end of the base member and an external wing of the backrest member. Because the compression spring is disposed completely outside with respect to the backrest member, the same compression spring is not only totally visible, with negative impact to the aesthetics of the chair, but also subject to knocks and damages.

One purpose of the present invention is to achieve a cushioning device for a backrest of a chair that will resist a very high number of actuation cycles, more than the 120,000 laid down by the legislation in force.

Another purpose of the present invention is to achieve a cushioning device which is simple and economical to make, and which can be replaced or repaired easily in the event of malfunctions or breakage, without necessarily requiring the replacement of the whole device or of the chair.

In accordance with these purposes, the Applicant has devised, tested and embodied the present invention, to overcome the shortcomings of the state of the art, and to obtain other purposes and advantages.

SUMMARY OF THE INVENTION

The cushioning device according to the present invention, to cushion a backrest of a chair or suchlike, is set forth and characterized in the main claim, while the dependent claims describe other characteristics of the present invention or variants to the idea of the main embodiment.

The device according to the present invention comprises a first supporting element, connectable to the backrest of the chair, a second supporting element pinned to the first supporting element and connectable to the seat of the chair, and a spring disposed with its longitudinal axis substantially vertical and connected both to said first supporting element and to said second supporting element for allowing a reciprocal elastic oscillation, of a determined amplitude, between said seat and said backrest.

In accordance with a first characteristic of the device according to the present invention, the first supporting element comprises a wall substantially vertical, or little inclined with respect to the vertical plane, in which wall a lodging seat is provided to lodge, at least partially, said spring in such a manner that the longitudinal axis of said spring is substantially aligned, or little inclined, with respect to said wall.

Advantageously said spring is able to work under compression and can consist of a helical spring, a gas piston, or another elastic element with equivalent functions.

According to a variant, the axial load spring can work under traction and can in any case consist of a helical spring, or another elastic element with equivalent functions.

The advantage to have the spring substantially aligned with one of the two supporting elements is that, despite the oscillation of one supporting element with respect to the other, the force that acts on the spring remains substantially of an axial type, so that the breaking limit of the same spring and of the entire device are increased.

The applicant has in fact found in experiments that the device according to the present invention resists up to more than 140,000 stresses before arriving at breaking point of the spring.

This guarantees great reliability of the cushioning device and consequently a satisfactory quality and long duration of the chair on which the device is mounted.

Advantageously the spring is positioned so as to normally keep the first and the second supporting elements in a position of reciprocal closure, that is, with the backrest thrust towards the front part of the chair.

Both the first and also the second supporting element are advantageously made by means of metal sheet bent, sheared and/or molded, while the spring is made of harmonic steel. One of the two supporting elements, for example the first one, comprises lateral walls provided with guiding eyelets inside which a transversal peg is inserted, which peg is inserted in a removable manner in a hole of the other supporting element, for example the second one, so as to define the amplitude of the reciprocal oscillation between the two supporting elements.

BRIEF DESCRIPTION OF THE DRAWINGS

These and other characteristics of the present invention will become apparent from the following description of a preferential form of embodiment, given as a non-restrictive example, with reference to the attached drawings wherein.

DESCRIPTION OF A PREFERENTIAL FORM OF EMBODIMENT

Figure 1:
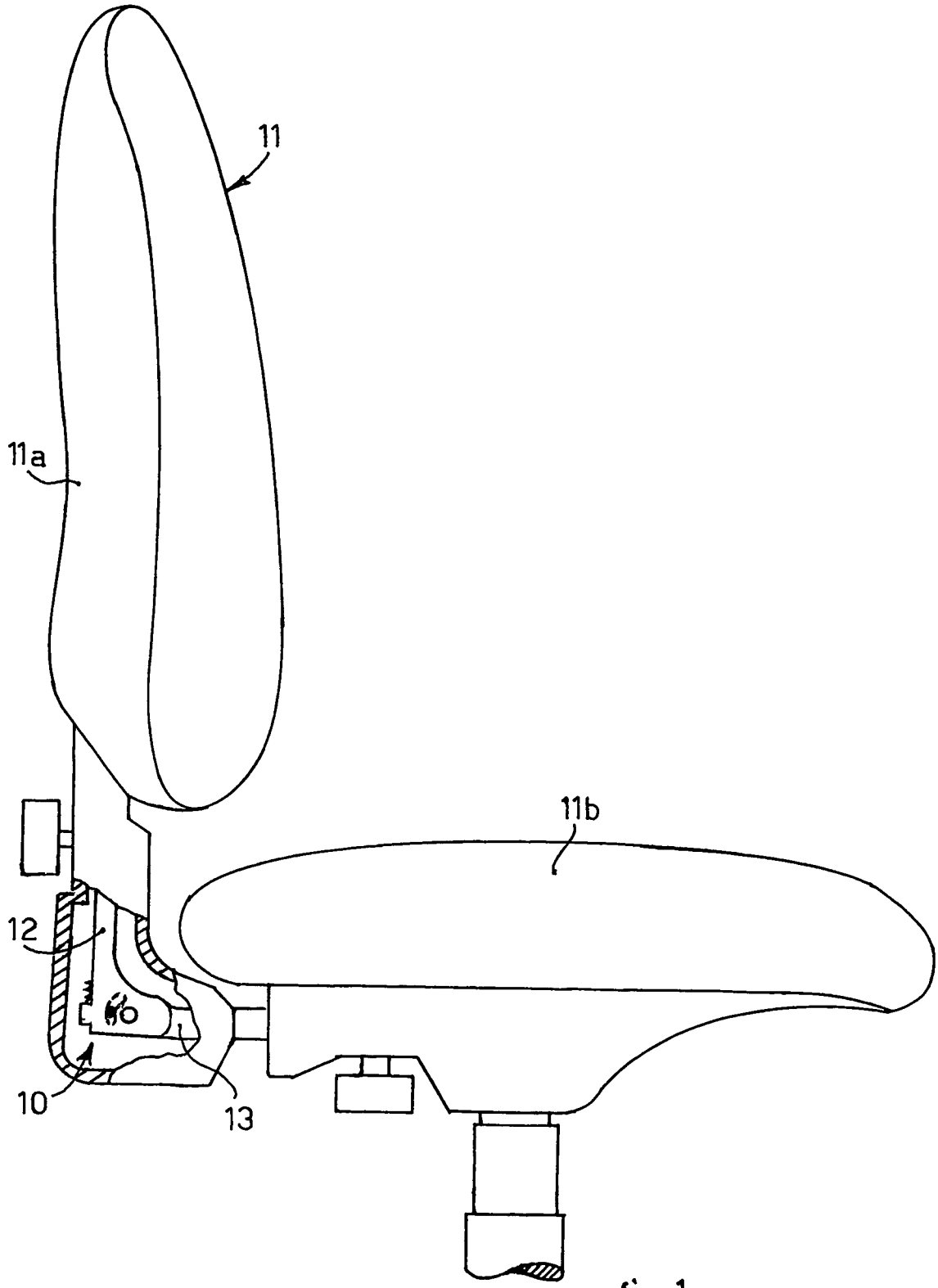
FIG. 1 is a partly sectioned side view of an office chair, on which a cushioning device according to the present invention is mounted.

With reference to FIG. 1, a cushioning device 10 according to the present invention is applied on an office chair 11, of the type provided with a backrest 11*a* and a seat 11*b*.

The device 10 comprises a first supporting element, or upright 12, substantially vertical and connected to the backrest 11*a*, and a second supporting element, or bracket 13, substantially horizontal and connected to the base of the seat 11*b*.

Figure 2:
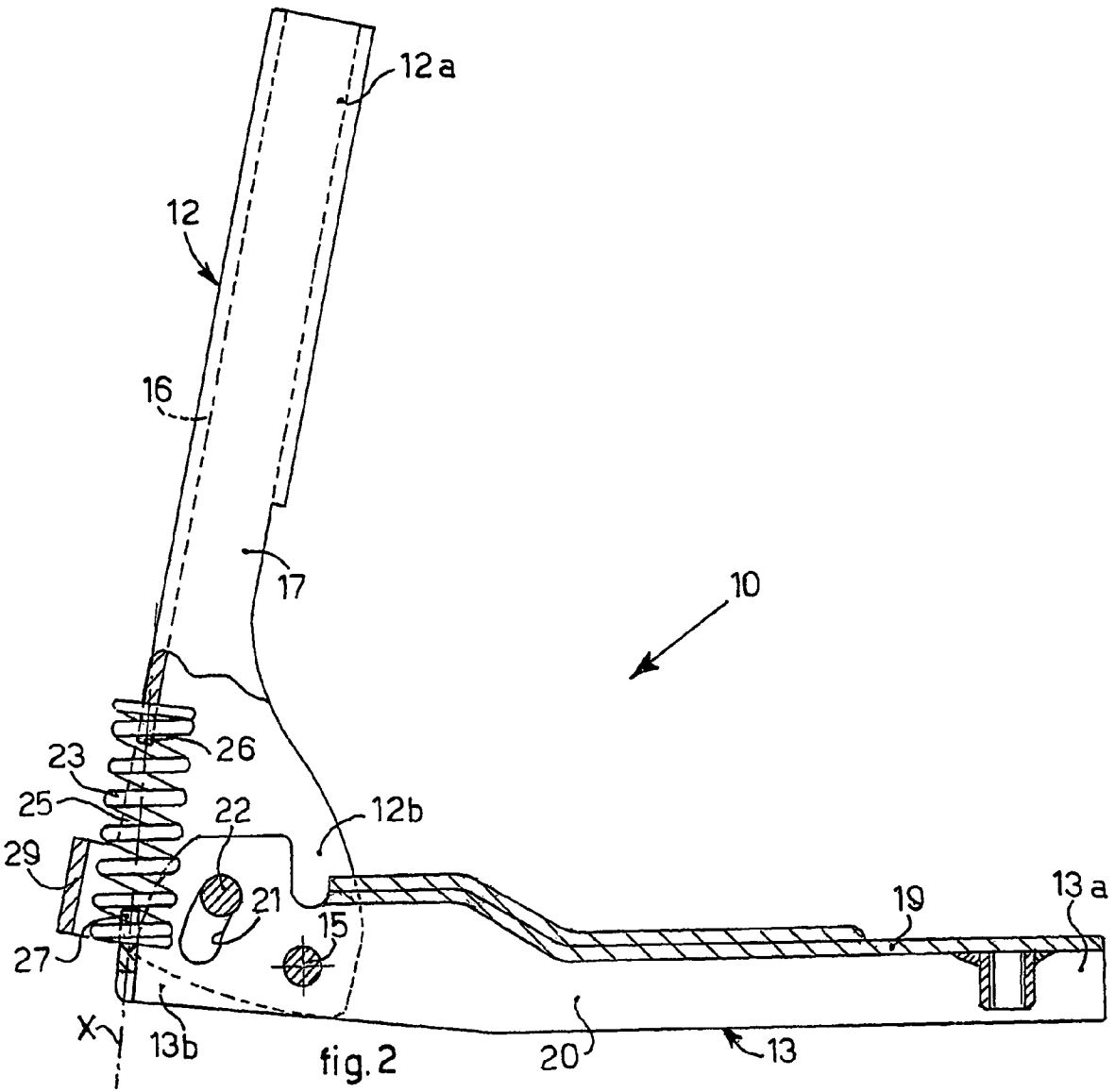
FIG. 2 is a side view, enlarged and partly sectioned, of a detail of the device in FIG. 1.
Figure 3:
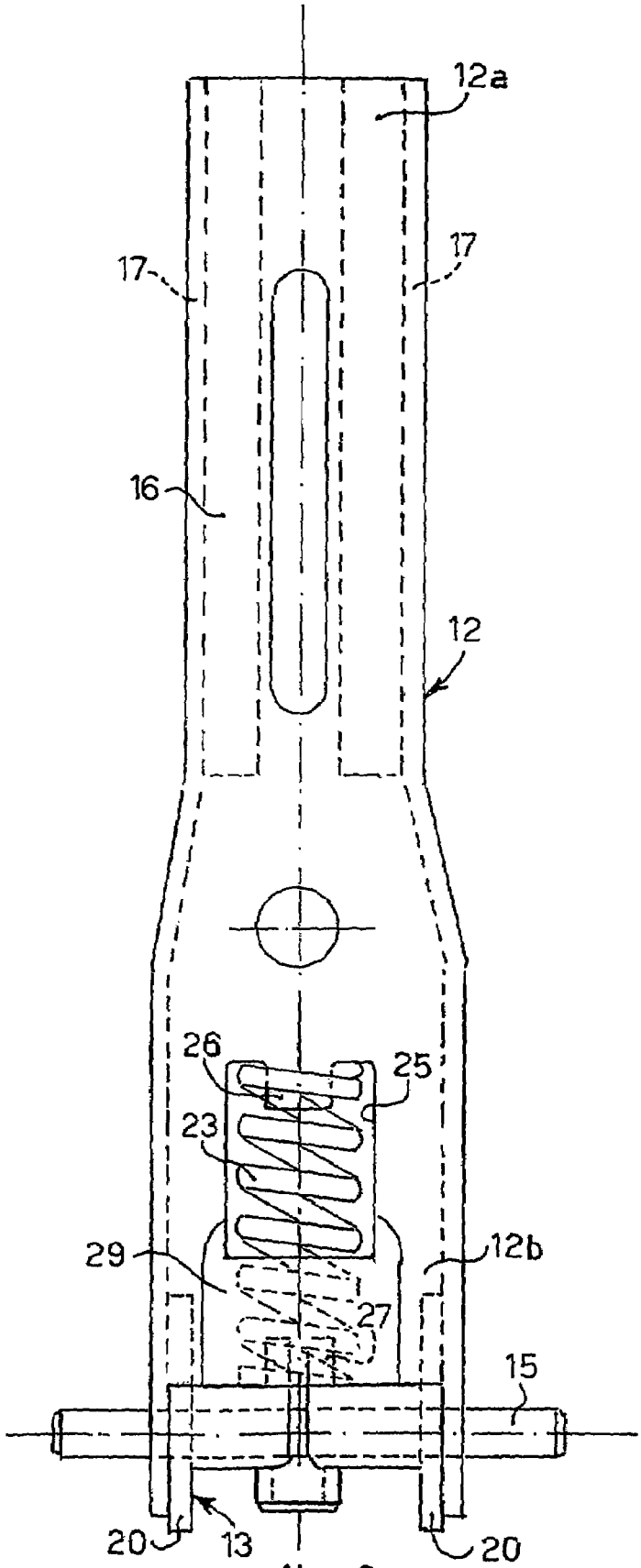
FIG. 3 is a rear view of the device in FIG. 2.

Both the upright 12 and the bracket 13 are made of metal sheet bent and shaped in such a manner that each one has a substantially C-shaped cross section (FIGS. 2 and 3). More in particular, the upright 12 comprises a rear wall 16 and two lateral walls 17 substantially parallel therebetween and perpendicular to the rear wall 16. An upper part 12*a* of the upright 12 is connected, in any known manner, to the backrest 11*a*, while a lower part 12*b* of the upright 12, larger than said upper part 12*a*, is coupled to the bracket 13 by means of a metal pin 15.

The bracket 13 comprises an upper wall 19 substantially horizontal and two lateral walls 20 substantially vertical. A front portion 13*a* (on the right in FIG. 2) of the bracket 13 is connected, in any known manner, to the seat 11*b*, while a rear portion 13*b* of the bracket 13 (on the left in FIG. 2) supports the metal pin 15. The rear portion 13*b* is a little narrower than the internal distance between the lateral walls 17 of the lower part 12*b* of the upright 12.

On the lateral walls 20 of the bracket 13, near the pin 15, there are two corresponding through eyelets 21, into which a peg 22 is inserted, preferably in a removable manner. The peg 22 is supported by the lateral walls 17 of the upright 12. In this way the backwards inclination of the upright 12 and of the backrest 11*a* connected thereto, with respect to the bracket 13 and the seat 11*b*, which remain still, is defined by the amplitude of the eyelets 21.

A helical spring 23, made for example of harmonic steel, is disposed between the upright 12 and the bracket 13.

More in particular, the upright 12 is shaped in such a manner that a lodging seat 25 is realized in its rear wall 16, substantially vertical, or little inclined (about 10-12°) with respect to the vertical plane. In the lodging seat 25, which is preferably realized by shearing or by molding, is lodged, at least partially, the helical spring 23, so that the longitudinal axis X of the helical spring 23 is substantially coincident with the rear wall 16, or little inclined (5-6°) with respect thereto. The lodging seat 25 is shaped so as to comprise a first tooth 26, made in one piece with the rear wall 16, faced downwards and inserted axially between the upper coils of the helical spring 23.

A second tooth 27, faced upwards, is made in one piece on the end of the rear portion 13*b* of the bracket 13. The second tooth 27 is inserted axially between the lower coils of the helical spring 23.

In this way, the helical spring 23 is disposed and constrained between the teeth 26 and 27 of the upright 12 and, respectively, of the bracket 13 and is substantially subjected to axial compression loads only, even when the backrest 11*a* is inclined to a greater extent with respect to the seat 11*b*. Therefore, it is assured to the device 10 a long duration and great reliability.

Moreover, the lodging seat 25 comprises a protection fin 29 also made in one piece with the rear wall 16 of the upright 12. The protection fin 29 has an arched development in order to be substantially coaxial to the helical spring 23, but without touching it. In this manner the helical spring 23 is also protected at the rear from possible accidental knocks which could damage it.

The functioning of the device 10 described heretofore is as follows.

In a rest position the upright 12 is little inclined forwards (i.e. to the right in FIGS. 1 and 2) with the rear wall 16 inclined of about 12° in a clockwise direction with respect to the vertical plane.

When the backrest 11*a* is inclined backwards (i.e. to the left in FIGS. 1 and 2), the upright 12 rotates in an anti-clockwise direction around the pin 15. The helical spring 23 is compressed to a greater or lesser extent, according to the oscilations to which the backrest 11*a* is subjected with respect to the seat 11*b*, which remain still, within the limits of the oscillation allowed by the eyelets 21 (about 24°). On the helical spring 23 act forces mostly, or almost exclusively, axial with consequent elastic reaction thereof which thus effects a cushioning action of the backrest 11*a*.

As has been verified during the duration trials, the helical spring 23 is able to support the compression at least the number of cycles provided by the European regulations in force, before it gives any sign of yielding and before it breaks.

Should the helical spring 23 break, it is in any case very simple to replace. It is sufficient to remove the peg 22 from the eyelets 21, and bend the backrest 11*a* forwards until the first tooth 26 is dis-associated from the helical spring 23. At this point it is sufficient to remove the spring 23 manually from the second tooth 27, replace it with a new one, and return the peg 22 into the eyelets 21.

In this way it is possible to perform any necessary maintenance operations easily, without having to replace the whole device 10, thus reducing the costs of production and storage for the spare parts.

It is clear, however, that modifications and/or additions of parts may be made to the device 10 as described heretofore, without departing from the field and scope of the present invention.

For example, according to a first variant, the spring 23 can be replaced by a gas piston or any other suitable compression element that produces an elastic or cushioning effect.

According to another variant, the spring 23 or possibly the gas piston can be arranged substantially aligned with the bracket 13. In this case the spring 23 is housed in a corresponding housing seating, not shown in the drawings, made on the upper wall 19 of the bracket 13 and clamped between the bracket 13 and the end 12*b* of the upright 12.

According to another variant, not shown in the drawings, the helical spring 23 can be made to work under traction, arranging it completely above the pin 15 and attaching it on one side to the tooth 26 and on the other side to a fixed peg of the bracket 13.

It is also clear that, although the present invention has been described with reference to specific examples, a skilled person shall certainly be able to achieve many other equivalent forms of cushioning device to cushion the backrest of a chair or suchlike, all of which shall come within the field of the present invention.

The invention claimed is:

1. Cushioning device to cushion a backrest with respect to the seat of a chair, comprising a first supporting element substantially vertical and connectable to said backrest, a second supporting element substantially horizontal and connectable to said seat, a pivoting element by means of which said first supporting element is pivoted to said second supporting element, and a helical spring disposed with its longitudinal axis substantially vertical and connected to said first supporting element and to said second supporting element to allow a reciprocal elastic movement, of a determined amplitude, between said backrest and said seat, wherein said first supporting element comprises a wall substantially vertical with respect to the vertical plane, wherein in said wall a lodging seat is provided to lodge, at least partially, said helical spring in such a manner that the longitudinal axis of said helical spring is substantially aligned with respect to said wall, wherein said spring is able to work by compression between said wall of said first supporting element and a rear portion of said second supporting element, and wherein a tooth is provided in said rear portion of said second supporting element, said tooth being faced upwards and inserted axially between the lower coils of said helical spring.

2. Cushioning device as in claim 1, wherein said first supporting element is made of metal sheet bent and shaped in such a manner that it has a substantially C-shaped cross section which includes said wall centrally and two lateral walls substantially parallel therebetween and perpendicular to said wall.

3. Cushioning device as in claim 1, wherein said lodging seat is realized in a lower part of said first supporting element, and wherein said pivoting element is disposed in said lower part, near to said helical spring.

4. Cushioning device as in claim 1, wherein said rear protection element is made in one piece in said wall for protecting at the rear said helical spring from possible accidental knocks.

5. Cushioning device as in claim 4, wherein said protection element has an arched development substantially coaxial to, but not in contact with, said helical spring.

6. Cushioning device as in claim 1, wherein said first supporting element and said second supporting element comprise limitation means disposed in an intermediate position between said pivoting element and said helical spring and able to limit the amplitude of the inclination of said backrest with respect to said seat.

7. Cushioning device as in claim 6, wherein said wall further comprises a second tooth faced downwards and inserted axially between the upper coils of said helical spring.

8. Cushioning device to cushion a backrest with respect to the seat of a chair, comprising a first supporting element substantially vertical and connectable to said backrest, a second supporting element substantially horizontal and connectable to said seat, a pivoting element by means of which said first supporting element is pivoted to said second supporting element, and a helical spring disposed with its longitudinal axis substantially vertical and connected to said first supporting element and to said second supporting element to allow a reciprocal elastic movement, of a determined amplitude, between said backrest and said seat, wherein said first supporting element comprises a wall substantially vertical with respect to the vertical plane, wherein in said wall a lodging seat is provided to lodge, at least partially, said helical spring in such a manner that the longitudinal axis of said helical spring is substantially aligned with respect to said wall, wherein said spring is able to work by compression between said wall of said first supporting element and a rear portion of said second supporting element, and wherein said wall further comprises a tooth faced downwards and inserted axially between the upper coils of said helical spring.

9. Cushioning device as in claim 8, wherein a second tooth is provided in said rear portion of said second supporting element, said second tooth being faced upwards and inserted axially between the lower coils of said helical spring.

10. Cushioning device as in claim 8, wherein a rear protection element is made in one piece in said wall for protecting at the rear said spring from possible accidental knocks.

11. Cushioning device as in claim 10, wherein said protection element has an arched development substantially coaxial to, but not in contact with, said spring.

* * * * *